US008054004B2

(12) United States Patent
Yang

(10) Patent No.: US 8,054,004 B2
(45) Date of Patent: Nov. 8, 2011

(54) BIPOLAR (DIS)CHARGING LED DRIVE METHOD AND CIRCUIT THEREOF

(76) Inventor: Tai-Her Yang, Dzan-Hwa (TW)

( * ) Notice: Subject to any disclaimer, the term of this patent is extended or adjusted under 35 U.S.C. 154(b) by 353 days.

(21) Appl. No.: 12/352,699

(22) Filed: Jan. 13, 2009

(65) Prior Publication Data

US 2009/0224689 A1 Sep. 10, 2009

Related U.S. Application Data

(60) Provisional application No. 61/034,708, filed on Mar. 7, 2008.

(51) Int. Cl.
*H05B 37/02* (2006.01)

(52) U.S. Cl. ..... 315/291; 315/307; 315/250

(58) Field of Classification Search ..... 315/246, 315/248, 250, 258, 283, 290, 291, 297, 307, 315/227 R, 228, 239, 244, 276
See application file for complete search history.

(56) References Cited

U.S. PATENT DOCUMENTS

| | | | | |
|---|---|---|---|---|
| 5,247,238 | A * | 9/1993 | Yang | 320/142 |
| 6,628,085 | B2 * | 9/2003 | Yang | 315/169.3 |
| 7,164,237 | B2 * | 1/2007 | Van Casteren | 315/209 R |
| 7,489,086 | B2 * | 2/2009 | Miskin et al. | 315/185 R |
| 7,564,198 | B2 * | 7/2009 | Yamamoto et al. | 315/307 |
| 7,868,561 | B2 * | 1/2011 | Weightman et al. | 315/294 |
| 2006/0197466 | A1 * | 9/2006 | Park | 315/224 |
| 2008/0211421 | A1 * | 9/2008 | Lee et al. | 315/250 |
| 2008/0231204 | A1 * | 9/2008 | Praiswater et al. | 315/192 |

* cited by examiner

*Primary Examiner* — Shawki S Ismail
*Assistant Examiner* — Crystal L Hammond
(74) *Attorney, Agent, or Firm* — Rabin & Berdo, P.C.

(57) ABSTRACT

A bipolar (dis)charge LED drive method and circuit thereof which is having a diode connected in series of forward polarity with an light emitting diode before being connected in parallel with a bipolar capacitor of the same polarity to constitute the first component, and having a diode, a capacitor and an optional light emitting diode to constitute the second component; the first and second components are connected in series of reversed polarity to be driven by AC, or DC power capable of periodical exchange polarity.

14 Claims, 6 Drawing Sheets

BIPOLAR (DIS)CHARGING LED DRIVE METHOD AND CIRCUIT THEREOF

BACKGROUND OF THE INVENTION (a) Field of the Invention

The present invention is related to an innovative circuit design of LED drive method and circuit that can be driven by AC or by a DC power source with period of polarity exchange, and more particularly, to one that the operation function is through the capacitor to produce bipolar charging/discharging electric power to drive the light emitting diode, so as to have the advantages of low thermal loss, power consumption, and production cost.

(b) Description of the Prior Art

Whereas conventionally a drive circuit in a light emitting diode driven by AC, or by a DC power source with period of polarity exchange has to be always comprised of a bridge rectification and a drop limiting resistance, thermal loss, wasted power, and increased production cost resulted from the light emitting diode has its flaws both of bridge rectification and drop limiting resistance are the flaws found with the LED of the prior art.

SUMMARY OF THE INVENTION

The primary purpose of the present invention is to provide a bipolar (dis)charging LED drive method and circuit thereof. The present invention is comprised of a first component and a second component in series connection of reversed polarity. The first component includes a diode series connected of forward polarity with an illuminating conduct polarity of a light emitting diode before being parallel connected with a bipolar capacitor; and the second component is either constituted by a diode and a bipolar capacitor in series connection, or the diode can be selected as needed to series connect with an optional light emitting diode, thereby the constitution method of the second component includes:

(1) when the optional light emitting diode is selected to be installed, the diode may be series connected with the light emitting diode at forward polarity with the illuminating conduct polarity of the light emitting diode before being parallel connected with a bipolar capacitor, thereby to constitute a first type of the second component; and (2) if the optional light emitting diode is selected not to be installed in the second component, the diode is parallel connected with the bipolar capacitor to constitute a second type of the second component.

The first component is connected in series of reversed polarity with either type of the second component to constitute a LED drive circuit (U100) capable of charging and discharging. The two ends of the LED drive circuit (U100) capable of charging and discharging are for inputting:

(1) The AC power with constant or variable voltage and constant or variable frequency; or (2) The electric power with constant or variable voltage and constant or variable polarities alternated periods converted from DC power source; or (3) The electric power with constant or variable voltage and constant or variable polarities alternated periods converted from DC power which is further rectified from AC power.

DESCRIPTION OF MAIN COMPONENT SYMBOLS

Figure 1:
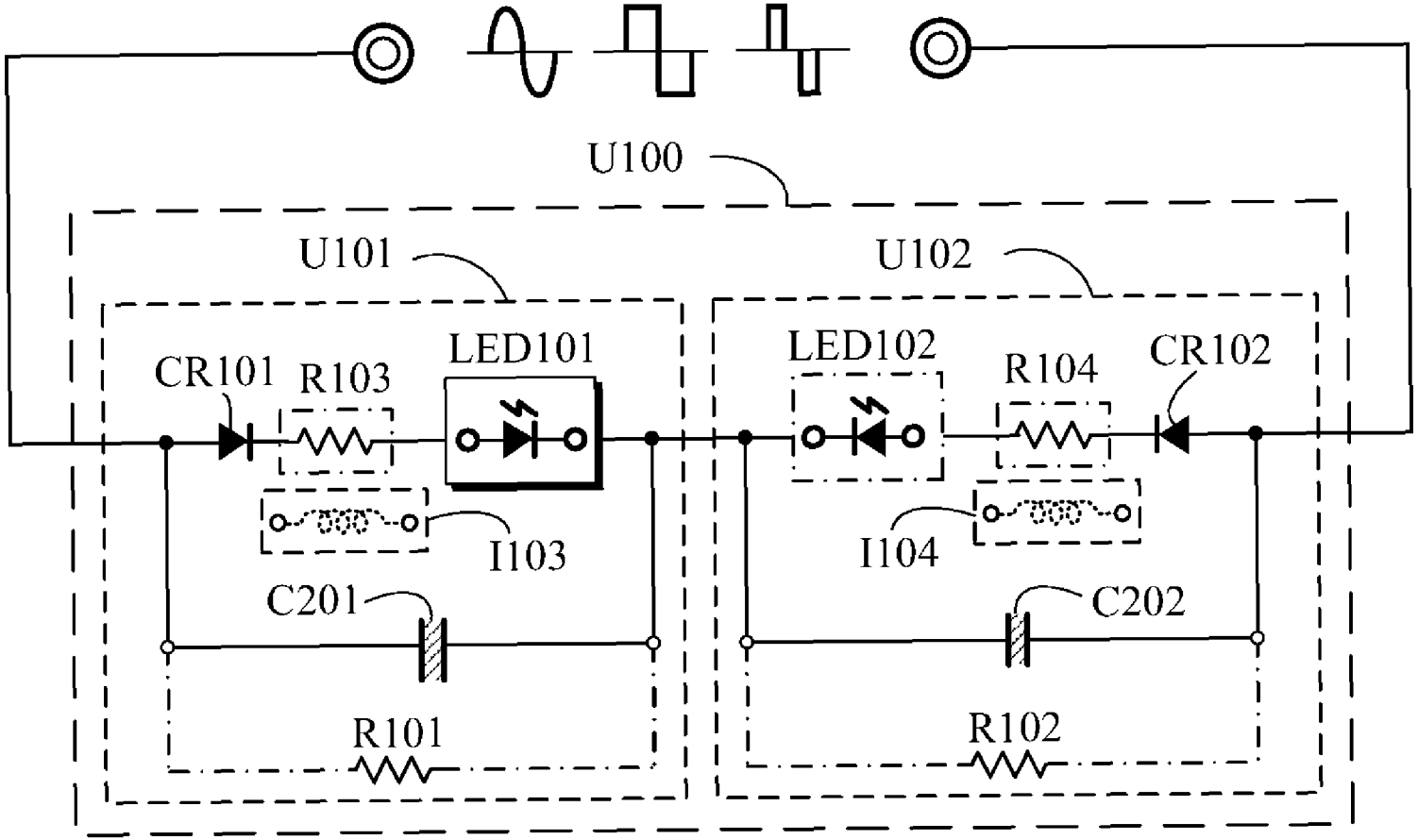
FIG. 1 is a schematic view showing a basic circuit configuration of the present invention.

C201, C202: Bipolar capacitor
CR101, CR102, CR201, CR202: Diode
ESD101, ESD102: Charge/discharge device
I103, I104: Inductive impedance component
LED101, LED102: Light emitting diode
R101, R102: Discharge resistor
R103, R104: Current limit resistor
U100: LED drive circuit capable of charging and discharging
U101: The first component
U102: The second component
ZD101, ZD102: Zener diode
300: AC power modulator of series connection type
310: AC power modulator of parallel connection type
400: Modulated periodically polarities alternated power modulator of series connection type
410: Modulated periodically polarities alternated power modulator of parallel connection type
500: Impedance component
600: Switching device
4000: DC to AC Inverter

DETAILED DESCRIPTION OF THE PREFERRED EMBODIMENTS

A bipolar (dis)charging LED drive method and circuit thereof disclosed in the present invention is comprised of a first component and a second component in series connection of reversed polarity. The first component is constituted by a diode connected in series of forward polarity with an illuminating conduct polarity of a light emitting diode before being connected in parallel with a bipolar capacitor; and the second component is either constituted by a diode and a bipolar capacitor in series connection, or the diode can be selected as needed to series connect with an optional light emitting diode. The constitution methods of the second component include: (1) when the optional light emitting diode is selected to be installed, the diode may be series connected with the light emitting diode at forward polarity with the illuminating conduct polarity of the light emitting diode before being parallel connected with a bipolar capacitor, thereby to constitute a first type of the second component; and (2) if the optional LED is selected not to be installed in the second component, the diode is parallel connected with the bipolar capacitor to constitute a second type of the second component.

The first component is connected in series of reversed polarity with either type of the second component to constitute an LED drive circuit (U100) capable of charging and discharging. The two ends of the LED drive circuit (U100) capable of charging and discharging are for inputting:

(1) The AC power with constant or variable voltage and constant or variable frequency; or (2) The electric power with constant or variable voltage and constant or variable polarities alternated periods converted from DC power source; or (3) The electric power with constant or variable voltage and constant or variable polarities alternated periods converted from DC power which is further rectified from AC power.

Referring to FIG. 1 is a schematic view of a basic circuit configuration of the present invention.

As illustrated in FIG. 1, the bipolar (dis)charging LED drive method and circuit thereof is using the bipolar capacitors (C201), (C202) to constitute the first component (U101) and the second component (U102) respectively, wherein it is essentially comprised including:

A bipolar capacitor: it is comprised of bipolar capacitors (C201), (C202) that are capable of bipolar charging and discharging, wherein said bipolar capacitors may be of same or different electric capacity;

The first component (U101): it is comprised of a diode (CR101) capable of executing uni-directional conduction in series connection of forward polarity to at least one light emitting diode (LED101) before being parallel connected with a bipolar capacitor, thereby to constitute the first component (U101);

The second component (U102): it is comprised of a diode (CR102) capable of executing uni-directional conduction in series connection of forward polarity to at least one light emitting diode (LED102) before being parallel connected with a bipolar capacitor, thereby to constitute the second component (U102);

In addition, if the light emitting diode (LED102) is selected not to be installed as needed, the diode (CR102) can be directly parallel connected with the bipolar capacitor (C202), thereby to constitute the second component (U102);

The first component (U101) and the second component (U102) are series connected of reversed polarity to constitute the LED drive circuit (U100) capable of charging and discharging, whereof the two ends of the LED drive circuit (U100) capable of charging and discharging is arranged for inputting:

(1) The AC power with constant or variable voltage and constant or variable frequency; or (2) The electric power with constant or variable voltage and constant or variable polarities alternated periods converted from DC power source; or (3) The electric power with constant or variable voltage and constant or variable polarities alternated periods converted from DC power which is further rectified from AC power.

In the LED drive circuit (U100) capable of charging and discharging, multiple matching modes are available for choice among the light emitting diode (LED101) constituting the first component (U101), and the light emitting diode (LED102) constituting the second component (U102) as follows:

1. The light emitting diode (LED101) is comprised of one or a plurality of light emitting diodes;

2. If the second component (U102) is selected to include the light emitting diode (LED102), the light emitting diode (LED102) is comprised of one or a plurality of light emitting diodes;

3. The constitution ways of the light emitting diode (LED101) or light emitting diode (LED102) include to be constituted individually by one light emitting diode of forward illuminating current polarity, or to be constituted by two or more than two light emitting diodes of forward illuminating current polarity in series or parallel connection, or to be constituted by three or more than three light emitting diodes of forward illuminating current polarity in series connection, parallel connection or series-parallel connection;

4. The numbers of light emitting diodes which constitute the light emitting diode (LED101) and the numbers of light emitting diodes which constitute the light emitting diode (LED102) can be the same or different;

5. Whereas the electric power source is related to an AC power source, or a bi-directional power source with polarity alternated periods that is converted from a DC power source, the light emitting diode (LED101) or the light emitting diode (LED102) is not continuously conducted by the DC power, thus to allow selection of a peak value of the working voltage for each light emitting diode referring to the inputted voltage wave shape and duty cycle of current conduction and disconnection, as well as a selected working current value. The selections include (1) having a voltage lower than a normal rated voltage as the peak voltage; (2) having the normal rated voltage as the peak voltage; and (3) having a voltage higher than the normal rated voltage as the peak voltage;

The present invention works on having a supply of power source with a polarity to charge the bipolar capacitor (C202) from the second component (U102) through the diode (CR101) and the light emitting diode (LED101) from the first component (U101), and the charged electric power keeps the light emitting diode (LED101) illuminated; and having the supply of power source with the other polarity to charge the bipolar capacitor (C201) from the first component (U101) through the diode (CR102) and the light emitting diode (LED102) from the second component (U102), and the charged electric power keeps the light emitting diode (LED102) illuminated. If the second component (U102) is not disposed with the light emitting diode (LED102), the electric power directly charges the bipolar capacitor (C201) from the first component (U101) through the diode (CR102) of the second component (U102).

Figure 2:
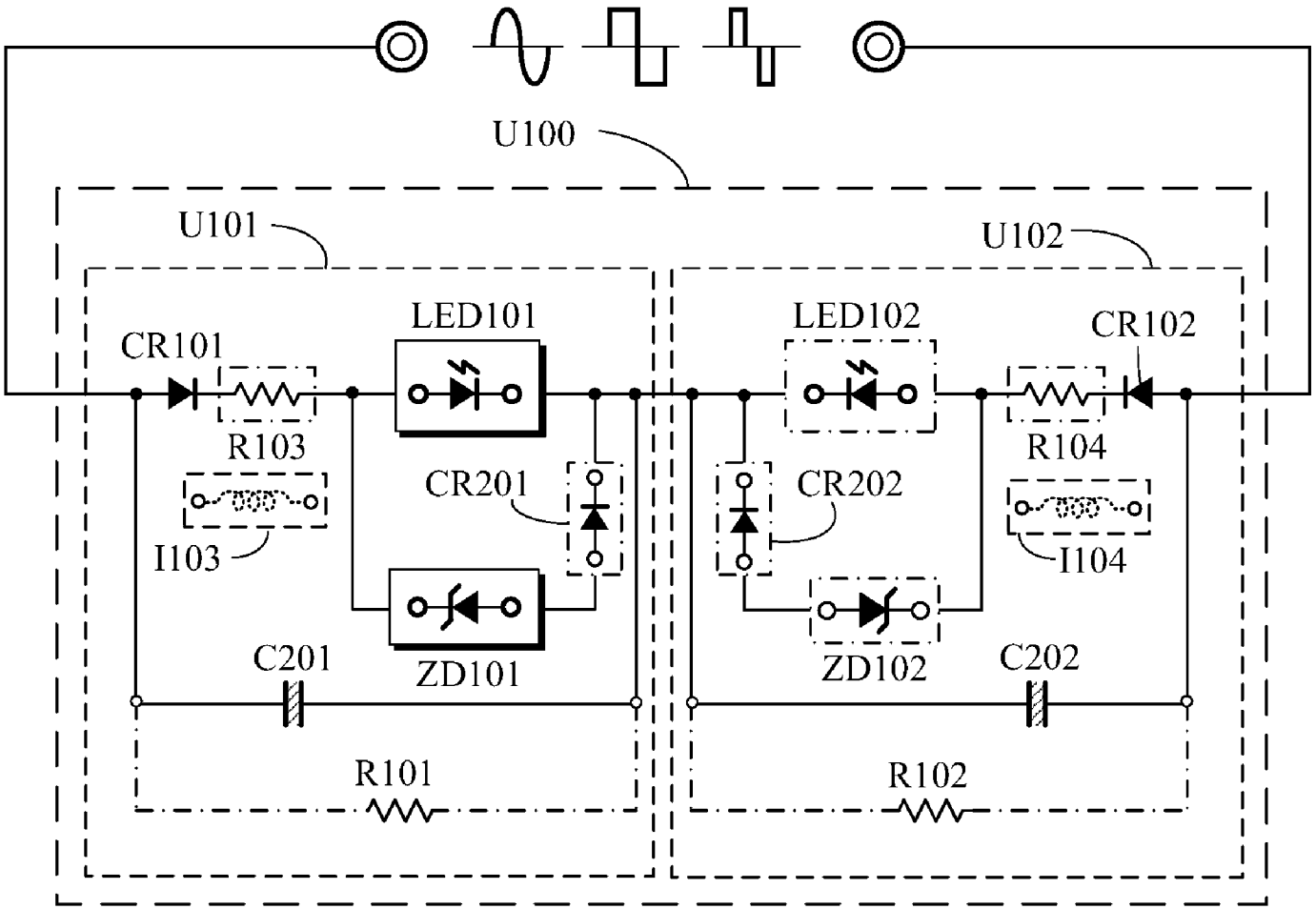
FIG. 2 is a circuit example schematic diagram showing a zener diode is further installed to a light emitting diode in the circuit of FIG. 1.

When applied in practical applications, the LED drive circuit (U100) capable of charging and discharging as illustrated in FIG. 1 may be optionally disposed with multiple auxiliary circuit components as applicable including the selection of either to be or not to be installed as needed and the selection of the installed quantity to be one or more than ones. In case of more than one components are selected, they can be in series connection, parallel connection or series-parallel connection of selected polarity relationship according to the requirements of the circuit function; the constituted components and the optional auxiliary circuit devices including:

The discharging resistance (R101): it is an optional device connected in parallel with both ends of the bipolar capacitor (C201) from the first component (U101) to discharge residual electric charge from the bipolar capacitor (C201);

The discharging resistance (R102): it is an optional device connected in parallel with both ends of the bipolar capacitor (C202) from the second component (U102) to discharge residual electric charge from the bipolar capacitor (C202);

The current limiting resistance (R103): it is an optional device which is arranged to be respectively connected in series to the diode (CR101) and the light emitting diode (LED101) from the first component (U101) to limit currents passing through the light emitting diode (LED101); the current limiting resistance (R103) may be replaced with an inductive resistance (I103);

The current limiting resistance (R104): it is an optional device which is arranged to be respectively connected in series to the diode (CR102) and the light emitting diode (LED102) from the second component (U102) to limit currents passing through the light emitting diode (LED102); the current limiting resistance (R104) may be replaced with an inductive resistance (I104);

In addition, to avoid the light emitting diode being damaged or reduced service life by abnormal voltage, in the LED drive circuit (U100) capable of charging and discharging of the present invention, a zener diode may be further connected in parallel with both ends of the light emitting diode; or at least one zener diode may be series connected with at least one diode to jointly generate zener voltage function for parallel connecting to both ends of the light emitting diode, as illustrated in FIG. 2 showing a circuit example schematic diagram of having added the zener diode to the light emitting diode in the circuit illustrated in FIG. 1. Detailed description is as follows:

In the circuit examples as illustrated in FIG. 2, a zener diode (ZD101) is parallel connected to both ends of the light emitting diode (LED101) from the first component (U101) to protect the light emitting diode, whereof their polarity relationship is that the zener voltage of the zener diode (ZD101) is used to limit the working voltage across the two ends of the light emitting diode (LED101); as applicable, the diode (CR201) may be selected to be series connected with the zener diode (ZD101), whereof providing advantages of (1) protecting the zener diode (ZD101) against reversed current; and (2) achieving temperature compensation results between the zener diode (ZD101) and the diode (CR201).

When the light emitting diode (LED102) is selected to be included in the second component (U102), a zener diode (ZD102) is parallel connected with both ends of the light emitting diode (LED102), whereof their polarity relationship is that the zener voltage of the zener diode (ZD102) is used to limit the working voltage across the two ends of the light emitting diode (LED102); as applicable, the diode (CR202) may be selected to be series connected with the zener diode (ZD102), whereof providing advantages of (1) protecting the zener diode (ZD102) against reversed current; and (2) achieving temperature compensation results between the zener diode (ZD102) and the diode (CR202).

Figure 3:
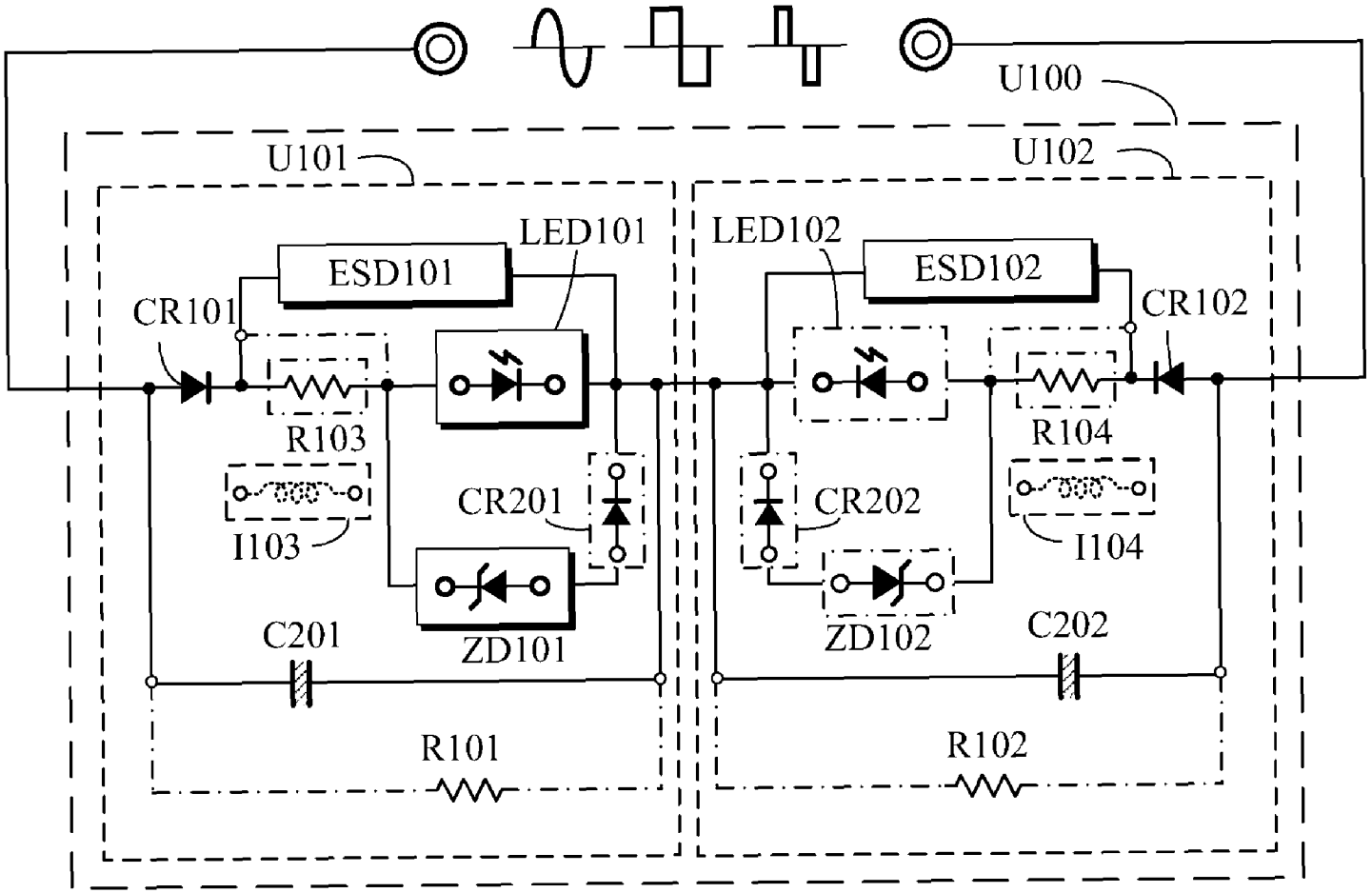
FIG. 3 is a circuit example schematic diagram showing that a charge/discharge device can be parallel connected across the two ends of a current limiting resistance and a light emitting diode in series connection in the circuit of FIG. 2.

To achieve the lighting stability of the light source produced by the light emitting diode and reduce the lighting pulsation, in the LED drive circuit (U100) capable of charging and discharging, both or at least one of the first component (U101) and the second component (U102) can be further installed with a charge/discharge device. FIG. 3 shows a circuit example schematic diagram that a charge/discharge device is parallel connected across the two ends of the light emitting diode and the series connected current limiting resistance in the circuit of FIG. 2.

In the circuit examples as illustrated in FIG. 3, to promote the lighting stability of the light source produced by the light emitting diode, the two ends of the light emitting diode (LED101) and the current limiting resistance (R103) in series connection from the first component (U101), or directly at the two ends of the light emitting diode (LED101) can be further parallel connected with a charge/discharge device (ESD101) according to the polarity for randomly charging or discharging the electric power, whereby to stabilize the operation of light emission from the light emitting diode (LED101). If the light emitting diode (LED102) is selected for the second component (U102), a charge/discharge device (ESD102) can be selected as needed to be parallel connected with the two ends of the light emitting diode (LED102) and the current limiting resistance (R104) in series connection, or directly parallel connected at the two ends of the light emitting diode (LED102) according to the polarity for randomly charging or discharging the electric power, whereby to stabilize the operation of light emission from the light emitting diode (LED102).

The charge/discharge devices (ESD101) and (ESD102) can be constituted by the conventional charging and discharging batteries, or super-capacitors or capacitors, etc.

In addition, the bipolar (dis)charging LED drive method and circuit thereof of the present invention, whereof both or at least one of the first component (U101) and the second component (U102) can be further disposed with the charge/discharge devices (ESD101), (ESD102) for randomly charging or discharging the electric power, whereby to stabilize the operation of light emission from the light emitting diodes (LED101) and (LED102); and in case of power failure, either or both of the reserved electric power in the charge/discharge devices (ESD101) and ESD 102 discharges the reserved electric power, so as to continue supplying power to maintain at least one of the light emitting diode (LED101) or (LED102) illuminated.

The first component (U101), the second component (U102), the light emitting diodes (LED101), (LED102) as well as various aforesaid optional auxiliary circuit components as illustrated in FIGS. 1 through 3 are based on application needs to be optionally installed or not installed as needed, and the installation quantity include constitution by one or more than ones, wherein if more than one components are selected in the application, they can be in series connection, parallel connection, or series-parallel connection of selected polarity relationship according to the requirements of the circuit function; whereby the constituted components and optional auxiliary circuit components including:

1. The first component (U101) can be constituted by one or by more than ones in series connection, parallel connection, or series-parallel connection;

2. The second component (U102) can be constituted by one or by more than ones in series connection, parallel connection, or series-parallel connection;

3. The light emitting diode (LED101) can be constituted by one light emitting diode of forward illuminating current polarity, or by two or more than two light emitting diodes in series or parallel connection of forward illuminating current polarity, or by three or more than three light emitting diodes in series connection, parallel connection, or series-parallel connection of forward illuminating current polarity;

4. The light emitting diode (LED102) can be constituted by one light emitting diode of forward illuminating current polarity, or by two or more than two light emitting diodes in series or parallel connection of forward illuminating current polarity, or by three or more than three light emitting diodes in series connection, parallel connection, or series-parallel connection of forward illuminating current polarity;

5. The discharging resistance (R101) can be constituted by one or by more than ones in series connection, parallel connection, or series-parallel connection;

6. The discharging resistance (R102) can be constituted by one or by more than ones in series connection, parallel connection, or series-parallel connection;

7. The current limiting resistance (R103) can be constituted by one or by more than ones in series connection, parallel connection, or series-parallel connection;

8. The current limiting resistance (R104) can be constituted by one or by more than ones in series connection, parallel connection, or series-parallel connection;

9. The current limiting inductive resistance (I103) can be constituted by one or by more than ones in series connection, parallel connection, or series-parallel connection;

10. The current limiting inductive resistance (I104) can be constituted by one or by more than ones in series connection, parallel connection, or series-parallel connection;

11. The diode (CR101) can be constituted by one diode, or by more than one diodes in series connection of forward polarity, or in parallel connection of the same polarity, or in series-parallel connection;

12. The diode (CR102) can be constituted by one diode, or by more than one diodes in series connection of forward polarity, or in parallel connection of the same polarity, or in series-parallel connection;

13. The zener diode (ZD101) can be constituted by one zener diode, or by more than one zener diodes in series connection of forward polarity, or in parallel connection of the same polarity, or in series-parallel connection;

14. The zener diode (ZD102) can be constituted by one zener diode, or by more than one zener diodes in series connection of forward polarity, or in parallel connection of the same polarity, or in series-parallel connection;

15. The diode (CR201) can be constituted by one diode, or by more than one diodes in series connection of forward polarity, or in parallel connection of the same polarity, or in series-parallel connection;

16. The diode (CR202) can be constituted by one diode, or by more than one diodes in series connection of forward polarity, or in parallel connection of the same polarity, or in series-parallel connection;

17. The charge/discharge device (ESD101) can be constituted by one charge/discharge device or by more than one charge/discharge devices in series connection of forward polarity, or in parallel connection of the same polarity, or in series-parallel connection;

18. The charge/discharge device (ESD102) can be constituted by one charge/discharge device or by more than one charge/discharge devices in series connection of forward polarity, or in parallel connection of the same polarity, or in series-parallel connection;

When applied, the bipolar (dis)charging LED drive method and circuit thereof of the present invention can provide for inputting:

(1) The AC power with constant or variable voltage and constant or variable frequency; or (2) The electric power with constant or variable voltage and constant or variable polarities alternated periods converted from DC power source; or (3) The electric power with constant or variable voltage and constant or variable polarities alternated periods converted from DC power which is further rectified from AC power.

Figure 4:
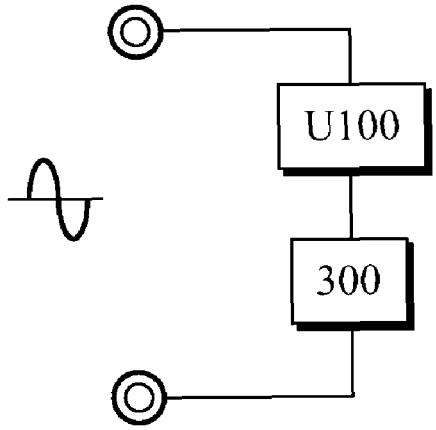
FIG. 4 is a circuit example schematic block diagram showing that the present invention is series connected to an AC power modulator of series connection type.
Figure 5:
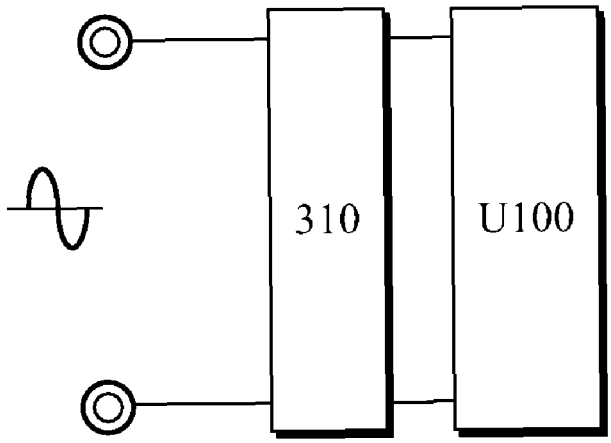
FIG. 5 is a circuit example schematic block diagram showing that the present invention is parallel connected with an AC power modulator of parallel connection type.
Figure 6:
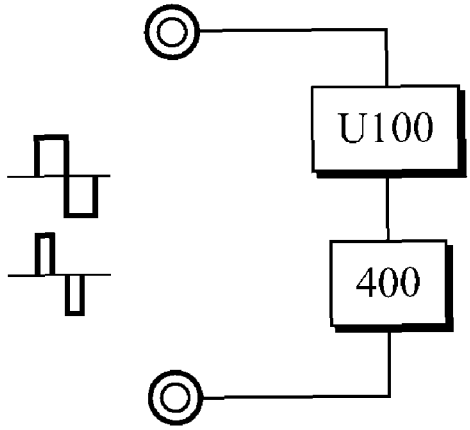
FIG. 6 is a circuit example schematic block diagram showing that the present invention is series connected to a modulated periodically polarities alternated power modulator of series connection type.
Figure 7:
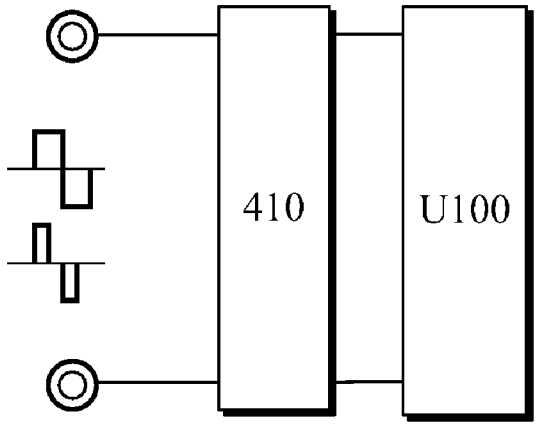
FIG. 7 is a circuit example schematic block diagram showing that the present invention is parallel connected with a modulated periodically polarities alternated power modulator of parallel connection type.
Figure 8:
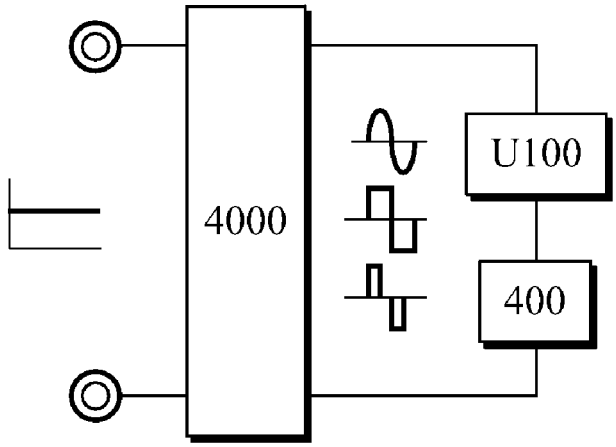
FIG. 8 is a circuit example schematic block diagram showing that the present invention is series connected to a modulated periodically polarities alternated power modulator of series connection type before is electrically driven by an output from DC to AC inverter.
Figure 9:
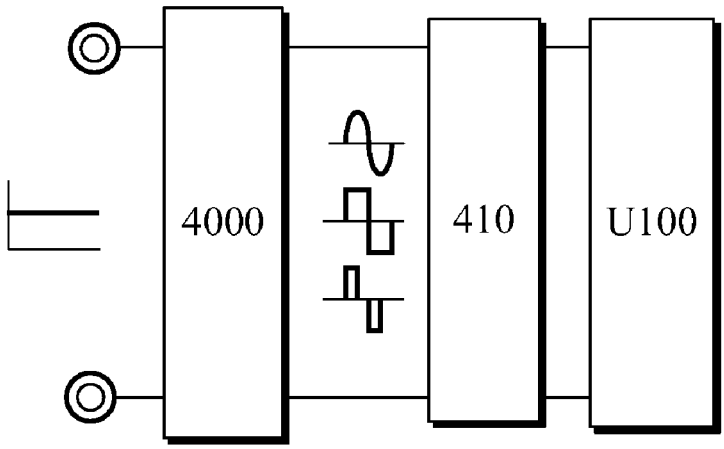
FIG. 9 is a circuit example schematic block diagram showing that the present invention is parallel connected with a modulated periodically polarities alternated power modulator of parallel connection type before is electrically driven by an output from a DC to AC inverter.
Figure 10:
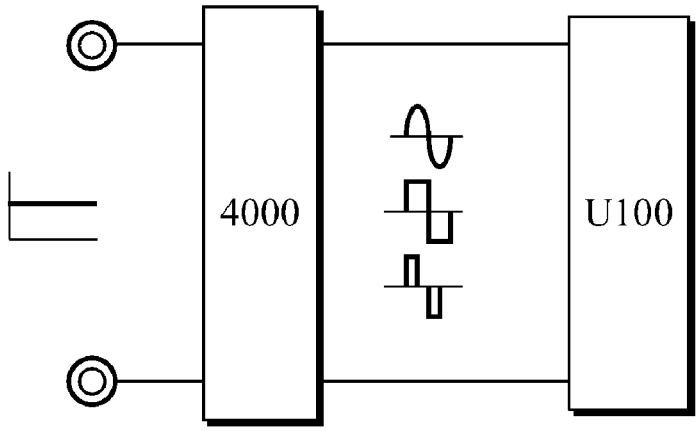
FIG. 10 is a circuit example schematic block diagram showing that the present invention is electrically driven by an output from a DC to AC inverter.
Figure 11:
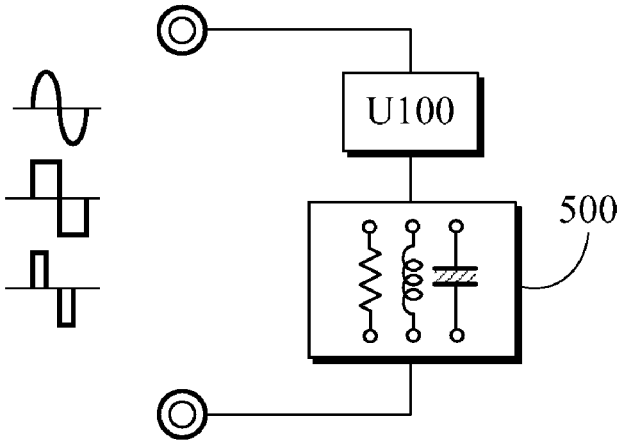
FIG. 11 is a circuit example schematic block diagram showing that the present invention is series connected with an impedance component.

In addition, the present invention can be further incorporated with the following active modulating circuit devices, whereof the active modulating circuit devices include:

The AC power modulator of series connection type (300): It is constituted by the conventional electromechanical components or solid state power components and related electronic circuit components to be series connected to the LED drive circuit (U100) capable of charging and discharging for receiving the electric power from AC power source, so as to execute power modulations including pulse width modulation (PWM), conduction phase angle control, and impedance modulation to the AC power with constant or variable voltage and constant or variable frequency from the power source;

The AC power modulator of parallel connection type (310): It is constituted by the conventional electromechanical components or solid state power components and related electronic circuit components, whereof its output ends are arranged to be parallel connected to the LED drive circuit (U100) capable of charging and discharging while its input ends are arranged to receive the AC power, so as to execute power modulations including pulse width modulation (PWM), conduction phase angle control, and impedance modulation to the AC power with constant or variable voltage and constant or variable frequency from the power source;

The modulated periodically polarities alternated power modulator of series connection type (400): It is constituted by the conventional electromechanical components or solid state power components and related electronic circuit components for series connected to the LED drive circuit (U100) capable of charging and discharging for receiving electric power from the power source, so as to execute power modulations including pulse width modulation (PWM), conduction phase angle control, and impedance modulation to either the electric power with constant or variable voltage and constant or variable polarities alternated periods converted from DC power, or the electric power with constant or variable voltage and constant or variable polarities alternated periods converted from DC power which is further rectified from the AC power source;

The modulated periodically polarities alternated power modulator of parallel connection type (410): It is constituted by the conventional electromechanical components or solid state power components and related electronic circuit components, whereof its output ends are arranged to be parallel connected to the LED drive circuit (U100) capable of charging and discharging while its input ends are arranged to receive the electric power from power source, so as to execute power modulations including pulse width modulation (PWM), conduction phase angle control, and impedance modulation to either the electric power with constant or variable voltage and constant or variable polarities alternated periods converted from DC power, or the electric power with constant or variable voltage and constant or variable polarities alternated periods converted from DC power which is further rectified from the AC power source;

The DC to AC inverter (4000): It is constituted by the conventional electromechanical components or solid state power components and related electronic circuit components, whereof its input ends are arranged to receive DC power with constant or variable voltage as selected while its output ends are arranged to output electric power of bi-directional sinusoidal wave, or bi-directional square wave or bi-directional pulsed wave with constant or variable voltage and constant or variable polarity alternated periods;

The impedance (500): it is comprised of at least one resistive impedance component, inductive impedance component and/or a capacitive impedance component or comprised of at least two or at least two kinds of impedance components mixed to execute series connection, parallel connection or series-parallel connection, whereby to provide DC impedance or AC impedance; or the capacitive impedance component and the inductive impedance component are mutually series connected to have the same frequency of the bi-directional electric power such as AC power from the power source or the same polarities alternated periods of the electric power with constant or variable voltage and constant or variable polarities alternated periods converted from DC power, thereby to appear a series resonance status and a corresponding end voltage status of series resonance across the two ends of the corresponding capacitive impedance component or inductive impedance component; or the capacitive impedance component and the inductive impedance component are mutually parallel connected to have the same frequency of the bi-directional electric power such as AC power from the power source or the same polarities alternated periods of the electric power with constant or variable voltage and constant or variable polarities alternated periods, thereby to appear a parallel resonance status and corresponding end voltage;

The switching device (600): it is constituted by dynamo-mechanical switching devices or solid-state switching devices to be arranged to modulate at least two impedance components (500) to execute switches among series, parallel, and series-parallel connections;

The bipolar (dis)charging LED drive method and circuit thereof of the present invention can constitute various application circuits as following by incorporating one kind of above mentioned active power modulators:

1. The present invention is series connected to an AC power modulator; wherein the LED drive circuit (U100) capable of charging and discharging is series connected to the conventional AC power modulator of series connection type (300) before driven by the inputted AC power with constant or variable voltage and constant or variable frequency, thereby to modulate the inputted power of the LED drive circuit (U100) capable of charging and discharging, whereof the connection method is to series connect the two devices; as illustrated in FIG. 4 is a circuit example schematic block diagram showing the present invention is series connected to an AC power modulator of series connection type;

2. The present invention is parallel connected with an AC power modulator; wherein the LED drive circuit (U100) capable of charging and discharging is parallel connected with the output ends of the conventional AC power modulator of parallel connection type (310) while the AC power with constant or variable voltage and constant or variable frequency is arranged to be inputted to the input ends of the AC power modulator of parallel connection type (310), then delivered through the output ends of the AC power modulator of parallel connection type (310) to the LED drive circuit (U100) capable of charging and discharging for modulating the inputted power of the LED drive circuit (U100) capable of charging and discharging as illustrated in FIG. 5 for a circuit example schematic block diagram of the present invention to be parallel connected with an AC power modulator of parallel connection type;

3. The LED drive circuit (U100) capable of charging and discharging is series connected to the conventional modulated periodically polarities alternated power modulator of series connection type (400) before receiving the electric power with constant or variable voltage and constant or variable polarities alternated periods converted from DC power, or the electric power with constant or variable voltage and constant or variable polarities alternated periods converted from DC power which is further rectified from the AC power, thereby to modulate the inputted power of the LED drive circuit (U100) capable of charging and discharging as illustrated in FIG. 6 for a circuit example schematic block diagram showing that the present invention is series connected to a modulated periodically polarities alternated power modulator of series connection type;

4. The LED drive circuit (U100) capable of charging and discharging is parallel connected with an output end of the conventional modulated periodically polarities alternated power modulator of parallel connection type (410); the electric power with constant or variable voltage and constant or variable polarities alternated periods converted from DC power, or the electric power with constant or variable voltage and constant or variable polarities alternated periods converted from DC power which is further rectified from AC power is arranged to be inputted to an input end of the modulated periodically polarities alternated power modulator of parallel connection type (410) and then outputted from an output end of modulated periodically polarities alternated power modulator of parallel connection type (410) to the LED drive circuit (U100) capable of charging and discharging for modulating the inputted power of the LED drive circuit (U100) capable of charging and discharging as illustrated in FIG. 7 for a circuit example schematic block diagram of the present invention to be parallel connected with a modulated periodically polarities alternated power modulator of parallel connection type;

5. The LED drive circuit (U100) capable of charging and discharging is series connected to the conventional modulated periodically polarities alternated power modulator of series connection type (400) before being parallel connected with an output end of the DC to AC inverter (4000); a DC power with constant or variable voltage selected as applicable is inputted into an input end of the DC to AC inverter (4000) while the output end of the DC to AC inverter (4000) outputs the electric power of bi-directional sinusoidal wave, or bi-directional square wave or bi-directional pulsed wave with constant or variable voltage and constant or variable polarities alternated periods selected as applicable to the LED drive circuit (U100) capable of charging and discharging for modulating the inputted power of the LED drive circuit (U100) capable of charging and discharging as illustrated in FIG. 8 for a circuit example schematic block diagram showing that the present invention is series connected to a modulated periodically polarities alternated power modulator of series connection type before being driven by the electric power outputted from a DC to AC inverter;

6. The LED drive circuit (U100) capable of charging and discharging is parallel connected with the an output end of the conventional modulated periodically polarities alternated power modulator of parallel connection type (410); a DC power with constant or variable voltage selected as applicable is inputted into an input end of the DC to AC inverter (4000) while the output end of the DC to AC inverter (4000) outputs electric power of bi-directional sinusoidal wave, or bi-directional square wave or bi-directional pulsed wave with constant or variable voltage and constant or variable polarity alternated periods selected as applicable to an input end of the modulated periodically polarities alternated power modulator of parallel connection type (410) before being outputted to the LED drive circuit (U100) capable of charging and discharging through an output end of the modulated periodically polarities alternated power modulator of parallel connection type (410) for modulating the inputted power of the LED drive circuit (U100) capable of charging and discharging as illustrated in FIG. 9 for a circuit example schematic block diagram showing that the present invention is parallel connected with a modulated periodically polarities alternated power modulator of parallel connection type before being driven by the electric power outputted from a DC to AC inverter;

7. The LED drive circuit (U100) capable of charging and discharging is parallel connected with an output end of the conventional DC to AC inverter (4000); a DC power with constant or variable voltage selected as applicable is inputted into an input end of the DC to AC inverter (4000) while the output end of the DC to AC inverter (4000) outputs electric power of bi-directional sinusoidal wave, or bi-directional square wave or bi-directional pulsed wave with constant or variable voltage and constant or variable polarity alternated periods selected as applicable to the LED drive circuit (U100) capable of charging and discharging for modulating the inputted power of the LED drive circuit (U100) capable of charging and discharging as illustrated in FIG. 10 for a circuit example schematic block diagram showing that the present invention is driven by the electric power outputted from a DC to AC inverter;

8. The LED drive circuit (U100) capable of charging and discharging is series connected to at least one conventional impedance component (500) before being parallel connected with a power source; wherein the impedance component (500) is comprised of:

(1) An impedance component (500): it is constituted by a component with capacitive impedance characteristics; or (2) An impedance component (500): it is constituted by a component with inductive impedance characteristics; or (3) An impedance component (500): it is constituted by a component with resistive impedance characteristics; or (4) An impedance component (500): it is constituted by a single impedance component with the combined impedance characteristics of at least two characteristics of the resistive impedance, or inductive impedance, or capacitive impedance simultaneously, thereby to provide DC or AC impedances; or (5) An impedance component (500): it is constituted by a single impedance component with the combined impedance characteristics of capacitive impedance and inductive impedance, whereof its inherent resonance frequency is the same as the frequency of the bi-directional electric power such as the AC power from the power source or the polarities alternated periods of the electric power with constant or variable voltage and constant or variable polarities alternated periods converted from DC power, thereby to produce a parallel resonance status; or (6) An impedance component (500): it is constituted by capacitive impedance components, or inductive impedance components, or resistive impedance components, including one or more than one kind of and one and more than one impedance component, or two or more than two kinds of one or more than one impedance components in series connection, or parallel connection, or series-parallel connections, thereby to provide a DC or AC impedance;

Or the capacitive impedance component and the inductive impedance component are in mutual series connection, whereby its inherent series resonance frequency is the same as the frequency of bi-directional electric power such as the AC power from power source, or the periods of the periodically alternated polarities DC power converted from DC power, thereby to produce an impedance status of series resonance status and appear the corresponding end voltage of series resonance at the two ends of corresponding capacitive impedance component or inductive impedance component;

Or the capacitive impedance component and the inductive impedance component are in mutual parallel connection, whereby its inherent parallel resonance frequency is the same as the frequency of bi-directional electric power such as the AC power from power source, or the periods of the periodically alternated polarities DC power converted from DC power, thereby to produce an impedance status of parallel resonance status and appear the corresponding end voltage;

FIG. 11 is a circuit example schematic block diagram showing that the present invention is series connected to an impedance component.

Figure 12:
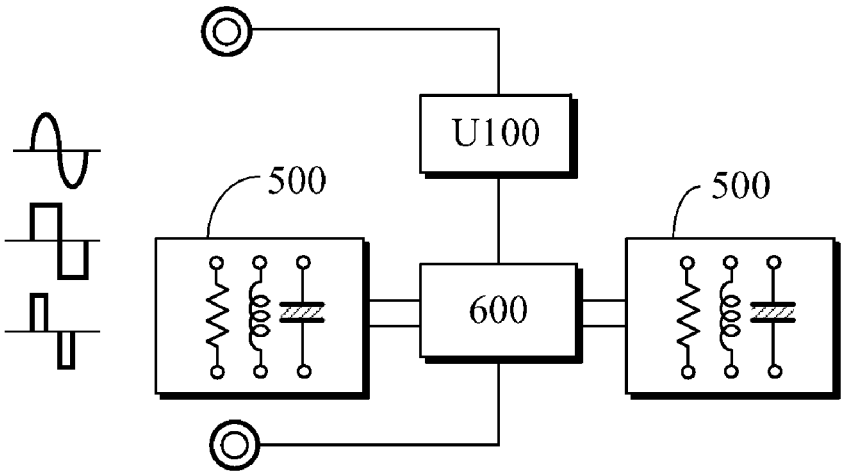
FIG. 12 is a circuit example schematic block diagram showing that the impedance components connected in series to the present invention executes series connection, parallel connection, or series and parallel connection by means of the switching device.

9. At least two impedance components (500) as said in the item 8 execute switches between series connection, parallel connection and series-parallel connection by means of the switching device (600) which is constituted by electromechanical components or solid state components, whereby to modulate the power transmitted to the LED drive circuit (U100) capable of charging and discharging, wherein FIG. 12 is a circuit example schematic block diagram showing that impedance components connected in series to the present invention executes series connection, parallel connection, or series-parallel connection by means of a switching device.

Colors of the individual light emitting diodes (LED101) and (LED102) of the first component (U101) and the second component (U102) in the bipolar (dis)charging LED drive method and circuit thereof can be optionally selected to be constituted by one or more than one colors.

The relationships of location arrangement between the individual light emitting diodes (LED101) and (LED102) of the first component (U101) and the second component (U102) in the bipolar (dis)charging LED drive method and circuit thereof include the following: 1) sequentially linear arrangement; 2) sequentially distributed in a plane; 3) crisscross-linear arrangement; 4) crisscross distribution in a plane; 5) arrangement based on particular geometric positions in a plane; 6) arrangement based on 3D geometric position.

The bipolar (dis)charging LED drive method and circuit thereof, in which it is constituted by circuit components which include: 1) It is constituted by individual circuit components which are inter-connected; 2) At least two circuit components are combined to at least two partial functioning units which are further inter-connected; 3) All components are integrated together to one structure.

Accordingly, a bipolar (dis)charging LED drive method and circuit thereof the present invention provides advanced features of power saving, low thermal loss and low cost in driving an LED by capacitance bipolar charging and discharging operation.

The invention claimed is:

1. A bipolar (dis)charging LED drive method and circuit thereof, which is comprised of a first component and a second component in series connection of reversed polarity, wherein the first component comprises a diode connected in series of forward polarity with an illuminating conduct polarity of a light emitting diode before being connected in parallel with a bipolar capacitor; and the second component either comprises a diode and a bipolar capacitor in series connection, or the diode can be selected as needed to series connect with an optional light emitting diode; the second component include: 1) when the optional light emitting diode is selected to be installed, the diode may be series connected with the light emitting diode at forward polarity with the illuminating conduct polarity of the light emitting diode before being parallel connected with a bipolar capacitor, thereby to comprise a first type of the second component; and 2) if the optional LED is selected not to be installed in the second component, the diode is parallel connected with the bipolar capacitor to comprise a second type of the second component;

the first component is connected in series of reversed polarity with either type of the second component to comprise an LED drive circuit (U100) capable of charging and discharging for inputting:

1) AC power with constant or variable voltage and constant or variable frequency; or 2) electric power with constant or variable voltage and constant or variable polarities alternated periods converted from DC power source; or 3) the electric power with constant or variable voltage and constant or variable polarities alternated periods converted from DC power which is further rectified from AC power;

including:

a bipolar capacitor comprised of bipolar capacitors (C201), (C202) that are capable of bipolar charging and discharging, wherein said bipolar capacitors may be of same or different electric capacity;

the first component (U101) comprised of a diode (CR101) capable of executing uni-directional conduction in series connection of forward polarity to at least one light emitting diode (LED101) before being parallel connected with a bipolar capacitor;

the second component (U102) comprised of a diode (CR102) capable of executing uni-directional conduction in series connection of forward polarity to at least one light emitting diode (LED102) before being parallel connected with a bipolar capacitor;

the first component (U101) can include one or more than one in series connection, parallel connection, or series-parallel connection;

the second component (U102) can include one or more than one in series connection, parallel connection, or series-parallel connection;

in addition, if the light emitting diode (LED102) is selected not to be installed as needed, the diode (CR102) can be directly parallel connected with the bipolar capacitor (C202), thereby to constitute the second component (U102);

the first component (U101) and the second component (U102) are series connected of reversed polarity to constitute the LED drive circuit (U100) capable of charging and discharging, wherein the two ends of the LED drive circuit (U100) capable of charging and discharging is arranged for inputting:

1) the AC power with constant or variable voltage and constant or variable frequency; or 2) the electric power with constant or variable voltage and constant or variable polarities alternated periods converted from DC power source; or 3) the electric power with constant or variable voltage and constant or variable polarities alternated periods converted from DC power which is further rectified from AC power;

the LED drive circuit (U100) is capable of charging and discharging, one or more than one matching modes are available for choice among the light emitting diode (LED101) comprising the first component (U101), and the light emitting diode (LED102) comprising the second component (U102) including:

1) the light emitting diode (LED101) is comprised of one or a plurality of light emitting diodes;

2) if the second component (U102) is selected to include the light emitting diode (LED102), the light emitting diode (LED102) is comprised of one or a plurality of light emitting diodes;

3) the light emitting diode (LED101) or light emitting diode (LED102) include one light emitting diode of forward illuminating current polarity, or two or more than two light emitting diodes of forward illuminating current polarity in series or parallel connection, or three or more than three light emitting diodes of forward illuminating current polarity in series connection, parallel connection or series-parallel connection;

4) the numbers of light emitting diodes which constitute comprise the light emitting diode (LED101) and the numbers of light emitting diodes which constitute the light emitting diode (LED102) can be the same or different;

5) wherein the electric power source is related to an AC power source, or a bi-directional power source with polarity alternated periods that is converted from a DC power source, the light emitting diode (LED101) or the light emitting diode (LED102) is not continuously conducted by the DC power, thus to allow selection of a peak value of the working voltage for each light emitting diode referring to the inputted voltage wave shape and duty cycle of current conduction and disconnection, as well as a selected working current value; the selections include i) having a voltage lower than a normal rated voltage as the peak voltage; ii) having the normal rated voltage as the peak voltage; and iii) having a voltage higher than the normal rated voltage as the peak voltage;

when having a supply of power source with a polarity to charge the bipolar capacitor (C202) from the second component (U102) through the diode (CR101) and the light emitting diode (LED101) from the first component (U101), and the charged electric power keeps the light emitting diode (LED101) illuminated; and having the supply of power source with the other polarity to charge the bipolar capacitor (C201) from the first component (U101) through the diode (CR102) and the light emitting diode (LED102) from the second component (U102), and the charged electric power keeps the light emitting diode (LED102) illuminated; if the second component (U102) is not disposed with the light emitting diode (LED102), the electric power directly charges the bipolar capacitor (C201) from the first component (U101) through the diode (CR102) of the second component (U102).

2. A bipolar (dis)charging LED drive method and circuit thereof as claimed in claim 1, wherein in practical applications, the LED drive circuit (U100) capable of charging and discharging may be optionally disposed with multiple auxiliary circuit components as applicable including the selection of either to be or not to be installed as needed and the selection of the installed quantity to be one or more than ones; in case of more than one components are selected, they can be in series connection, parallel connection or series-parallel connection of selected polarity relationship according to the requirements of the circuit function; the components and the optional auxiliary circuit devices including:

the discharging resistance (R101): it is an optional device connected in parallel with both ends of the bipolar capacitor (C201) from the first component (U101) to discharge residual electric charge from the bipolar capacitor (C201);

the discharging resistance (R102): it is an optional device connected in parallel with both ends of the bipolar capacitor (C202) from the second component (U102) to discharge residual electric charge from the bipolar capacitor (C202);

the current limiting resistance (R103): it is an optional device which is arranged to be respectively connected in series to the diode (CR101) and the light emitting diode (LED101) from the first component (U101) to limit currents passing through the light emitting diode (LED101); the current limiting resistance (R103) may be replaced with an inductive resistance (1103);

the current limiting resistance (R104): it is an optional device which is arranged to be respectively connected in series to the diode (CR102) and the light emitting diode (LED102) from the second component (U102) to limit currents passing through the light emitting diode (LED102); the current limiting resistance (R104) may be replaced with an inductive resistance (1104).

3. A bipolar (dis)charging LED drive method and circuit thereof as claimed in claim 1, wherein to avoid the light emitting diode being damaged or reduced service life by abnormal voltage, in the LED drive circuit (U100) capable of charging and discharging of the present invention, a zener diode may be further connected in parallel with both ends of the light emitting diode; or at least one zener diode may be series connected with at least one diode to jointly generate zener voltage function for parallel connecting to both ends of the light emitting diode, including:

a zener diode (ZD101) is parallel connected to both ends of the light emitting diode (LED101) from the first component (U101) to protect the light emitting diode, wherein their polarity relationship is that the zener voltage of the zener diode (ZD101) is used to limit the working voltage across the two ends of the light emitting diode (LED101); as applicable, the diode (CR201) may be selected to be series connected with the zener diode (ZD101), wherein providing advantages of 1) protecting the zener diode (ZD101) against reversed current; and 2) achieving temperature compensation results between the zener diode (ZD101) and the diode (CR201);

when the light emitting diode (LED102) is selected to be included in the second component (U102), a zener diode (ZD102) is parallel connected with both ends of the light emitting diode (LED102), wherein their polarity relationship is that the zener voltage of the zener diode (ZD102) is used to limit the working voltage across the two ends of the light emitting diode (LED102); as applicable, the diode (CR202) may be selected to be series connected with the zener diode (ZD102), wherein providing advantages of 1) protecting the zener diode (ZD102) against reversed current; and 2) achieving temperature compensation results between the zener diode (ZD102) and the diode (CR202).

4. A bipolar (dis)charging LED drive method and circuit thereof as claimed in claim 1, wherein to achieve the lighting stability of the light source produced by the light emitting diode and reduce the lighting pulsation, both or at least one of the first component (U101) and the second component (U102) can be further installed with a charge/discharge device, including:

the two ends of the light emitting diode (LED101) and the current limiting resistance (R103) in series connection from the first component (U101), or directly at the two ends of the light emitting diode (LED101) can be further parallel connected with a charge/discharge device (ESD101) according to the polarity for randomly charging or discharging the electric power, whereby to stabilize the operation of light emission from the light emitting diode (LED101); if the light emitting diode (LED102) is selected for the second component (U102), a charge/discharge device (ESD102) can be selected as needed to be parallel connected with the two ends of the light emitting diode (LED102) and the current limiting resistance (R104) in series connection, or directly parallel connected at the two ends of the light emitting diode (LED102) according to the polarity for randomly charging or discharging the electric power, whereby to stabilize the operation of light emission from the light emitting diode (LED102);

the charge/discharge devices (ESD101) and (ESD102) can comprise the conventional charging and discharging batteries, or super-capacitors or capacitors.

5. A bipolar (dis)charging LED drive method and circuit thereof as claimed in claim 1, wherein both or at least one of the first component (U101) and the second component (U102) can be further disposed with the charge/discharge devices (ESD101), (ESD102) for randomly charging or discharging the electric power, whereby to stabilize the operation of light emission from the light emitting diodes (LED101) and (LED102); and in case of power failure, either or both of the reserved electric power in the charge/discharge devices (ESD101) and ESD 102 discharges the reserved electric power, so as to continue supplying power to maintain at least one of the light emitting diode (LED101) or (LED102) illuminated.

6. A bipolar (dis)charging LED drive method and circuit thereof as claimed in claim 1, further incorporating the following active modulating circuit devices, wherein the active modulating circuit devices include one or more than one device including:

the AC power modulator of series connection type (300) comprises the conventional electromechanical components or solid state power components and related electronic circuit components to be series connected to the LED drive circuit (U100) capable of charging and discharging for receiving the electric power from AC power source, so as to execute power modulations including pulse width modulation (PWM), conduction phase angle control, and impedance modulation to the AC power with constant or variable voltage and constant or variable frequency from the power source;

the AC power modulator of parallel connection type (310) comprises the conventional electromechanical components or solid state power components and related electronic circuit components, wherein its output ends are arranged to be parallel connected to the LED drive circuit (U100) capable of charging and discharging while its input ends are arranged to receive the AC power, so as to execute power modulations including pulse width modulation (PWM), conduction phase angle control, and impedance modulation to the AC power with constant or variable voltage and constant or variable frequency from the power source;

the modulated periodically polarities alternated power modulator of series connection type (400) comprises the conventional electromechanical components or solid state power components and related electronic circuit components for series connected to the LED drive circuit (U100) capable of charging and discharging for receiving electric power from the power source, so as to execute power modulations including pulse width modulation (PWM), conduction phase angle control, and impedance modulation to either the electric power with constant or variable voltage and constant or variable polarities alternated periods converted from DC power, or the electric power with constant or variable voltage and constant or variable polarities alternated periods converted from DC power which is further rectified from the AC power source;

the modulated periodically polarities alternated power modulator of parallel connection type (410) comprises the conventional electromechanical components or solid state power components and related electronic circuit components, wherein its output ends are arranged to be parallel connected to the LED drive circuit (U100) capable of charging and discharging while its input ends are arranged to receive the electric power from power source, so as to execute power modulations including pulse width modulation (PWM), conduction phase angle control, and impedance modulation to either the electric power with constant or variable voltage and constant or variable polarities alternated periods converted from DC power, or the electric power with constant or variable voltage and constant or variable polarities alternated periods converted from DC power which is further rectified from the AC power source;

the DC to AC inverter (4000) comprises the conventional electromechanical components or solid state power components and related electronic circuit components, wherein its input ends are arranged to receive DC power with constant or variable voltage as selected while its output ends are arranged to output electric power of bi-directional sinusoidal wave, or bi-directional square wave or bi-directional pulsed wave with constant or variable voltage and constant or variable polarity alternated periods;

the impedance (500) is comprised of at least one resistive impedance component, inductive impedance component and/or a capacitive impedance component or comprised of at least two or at least two kinds of impedance components mixed to execute series connection, parallel connection or series-parallel connection, whereby to provide DC impedance or AC impedance; or the capacitive impedance component and the inductive impedance component are mutually series connected to have the same frequency of the bi-directional electric power such as AC power from the power source or the same polarities alternated periods of the electric power with constant or variable voltage and constant or variable polarities alternated periods converted from DC power, thereby to appear a series resonance status and a corresponding end voltage status of series resonance across the two ends of the corresponding capacitive impedance component or inductive impedance component; or the capacitive impedance component and the inductive impedance component are mutually parallel connected to have the same frequency of the bi-directional electric power such as AC power from the power source or the same polarities alternated periods of the electric power with constant or variable voltage and constant or variable polarities alternated periods, thereby to appear a parallel resonance status and corresponding end voltage;

the switching device (600) comprises dynamo-mechanical switching devices or solid-state switching devices to be arranged to modulate at least two impedance components (500) to execute switches among series, parallel, and series-parallel connections.

7. A bipolar (dis)charging LED drive method and circuit thereof as claimed in claim 1, wherein the LED drive circuit (U100) capable of charging and discharging is series connected to the conventional AC power modulator of series connection type (300) before driven by the inputted AC power with constant or variable voltage and constant or variable frequency, thereby to modulate the inputted power of the LED drive circuit (U100) capable of charging and discharging, wherein the connection method is to series connect the two devices.

8. A bipolar (dis)charging LED drive method and circuit thereof as claimed in claim 1, wherein it includes that the LED drive circuit (U100) capable of charging and discharging is parallel connected with the output ends of the conventional AC power modulator of parallel connection type (310) while the AC power with constant or variable voltage and constant or variable frequency is arranged to be inputted to the input ends of the AC power modulator of parallel connection type (310), then delivered through the output ends of the AC power modulator of parallel connection type (310) to the LED drive circuit (U100) capable of charging and discharging for modulating the inputted power of the LED drive circuit (U100) capable of charging and discharging.

9. A bipolar (dis)charging LED drive method and circuit thereof as claimed in claim 1, wherein it includes that the LED drive circuit (U100) capable of charging and discharging is series connected to the conventional modulated periodically polarities alternated power modulator of series connection type (400) before receiving the electric power with constant or variable voltage and constant or variable polarities alternated periods converted from DC power, or the electric power with constant or variable voltage and constant or variable polarities alternated periods converted from DC power which is further rectified from the AC power, thereby to modulate the inputted power of the LED drive circuit (U100) capable of charging and discharging.

10. A bipolar (dis)charging LED drive method and circuit thereof as claimed in claim 1, wherein it includes that the LED drive circuit (U100) capable of charging and discharging is parallel connected with an output end of the conventional modulated periodically polarities alternated power modulator of parallel connection type (410); the electric power with constant or variable voltage and constant or variable polarities alternated periods converted from DC power, or the electric power with constant or variable voltage and constant or variable polarities alternated periods converted from DC power which is further rectified from AC power is arranged to be inputted to an input end of the modulated periodically polarities alternated power modulator of parallel connection type (410) and then outputted from an output end of modulated periodically polarities alternated power modulator of parallel connection type (410) to the LED drive circuit (U100) capable of charging and discharging for modulating the inputted power of the LED drive circuit (U100) capable of charging and discharging.

11. A bipolar (dis)charging LED drive method and circuit thereof as claimed in claim 1, wherein it includes that the LED drive circuit (U100) capable of charging and discharging is series connected to the conventional modulated periodically polarities alternated power modulator of series connection type (400) before being parallel connected with an output end of the DC to AC inverter (4000); a DC power with constant or variable voltage selected as applicable is inputted into an input end of the DC to AC inverter (4000) while the output end of the DC to AC inverter (4000) outputs the electric power of bi-directional sinusoidal wave, or bi-directional square wave or bi-directional pulsed wave with constant or variable voltage and constant or variable polarities alternated periods selected as applicable to the LED drive circuit (U100) capable of charging and discharging for modulating the inputted power of the LED drive circuit (U100) capable of charging and discharging.

12. A bipolar (dis)charging LED drive method and circuit thereof as claimed in claim 1, wherein includes that the LED drive circuit (U100) capable of charging and discharging is parallel connected with the an output end of the conventional modulated periodically polarities alternated power modulator of parallel connection type (410); a DC power with constant or variable voltage selected as applicable is inputted into an input end of the DC to AC inverter (4000) while the output end of the DC to AC inverter (4000) outputs electric power of bi-directional sinusoidal wave, or bi-directional square wave or bi-directional pulsed wave with constant or variable voltage and constant or variable polarity alternated periods selected as applicable to an input end of the modulated periodically polarities alternated power modulator of parallel connection type (410) before being outputted to the LED drive circuit (U100) capable of charging and discharging through an output end of the modulated periodically polarities alternated power modulator of parallel connection type (410) for modulating the inputted power of the LED drive circuit (U100) capable of charging and discharging.

13. A bipolar (dis)charging LED drive method and circuit thereof as claimed in claim 1, wherein it includes that the LED drive circuit (U100) capable of charging and discharging is parallel connected with an output end of the conventional DC to AC inverter (4000); a DC power with constant or variable voltage selected as applicable is inputted into an input end of the DC to AC inverter (4000) while the output end of the DC to AC inverter (4000) outputs electric power of bi-directional sinusoidal wave, or bi-directional square wave or bi-directional pulsed wave with constant or variable voltage and constant or variable polarity alternated periods selected as applicable to the LED drive circuit (U100) capable of charging and discharging for modulating the inputted power of the LED drive circuit (U100) capable of charging and discharging.

14. A bipolar (dis)charging LED drive method and circuit thereof as claimed in claim 1, wherein it includes that the LED drive circuit (U100) capable of charging and discharging is series connected to at least one conventional impedance component (500) before being parallel connected with a power source; wherein the impedance component (500) is comprised of:

1) an impedance component (500) comprising a component with capacitive impedance characteristics; or
2) an impedance component (500) comprising a component with inductive impedance characteristics; or
3) an impedance component (500) comprising a component with resistive impedance characteristics; or
4) an impedance component (500) comprising a single impedance component with the combined impedance characteristics of at least two characteristics of the resistive impedance, or inductive impedance, or capacitive impedance simultaneously, thereby to provide DC or AC impedances; or
5) an impedance component (500) comprising a single impedance component with the combined impedance characteristics of capacitive impedance and inductive impedance, wherein its inherent resonance frequency is the same as the frequency of the bi-directional electric power such as the AC power from the power source or the polarities alternated periods of the electric power with constant or variable voltage and constant or variable polarities alternated periods converted from DC power, thereby to produce a parallel resonance status; or
6) an impedance component (500) comprising capacitive impedance components, or inductive impedance components, or resistive impedance components, including one or more than one kind of and one and more than one impedance component, or two or more than two kinds of one or more than one impedance components in series connection, or parallel connection, or series-parallel connections, thereby to provide a DC or AC impedance;
   or the capacitive impedance component and the inductive impedance component are in mutual series connection, whereby its inherent series resonance frequency is the same as the frequency of bi-directional electric power such as the AC power from power source, or the periods of the periodically alternated polarities DC power converted from DC power, thereby to produce an impedance status of series resonance status and appear the corresponding end voltage of series resonance at the two ends of corresponding capacitive impedance component or inductive impedance component;
   or the capacitive impedance component and the inductive impedance component are in mutual parallel connection, whereby its inherent parallel resonance frequency is the same as the frequency of bi-directional electric power such as the AC power from power source, or the periods of the periodically alternated polarities DC power converted from DC power, thereby to produce an impedance status of parallel resonance status and appear the corresponding end voltage.

* * * * *